United States Patent [19]

Anderson et al.

[11] Patent Number: 4,992,140

[45] Date of Patent: Feb. 12, 1991

[54] METHOD FOR CREPING A PAPER WEB AND PRODUCT PRODUCED THEREBY

[75] Inventors: Ralph L. Anderson, Boothwyn; William H. Burgess, Jr., Wallingford; Wesley McConnell, Glen Mills; David L. Shaw, Springfield; John Thelman, West Chester, all of Pa.

[73] Assignee: Scott Paper Company, Philadelphia, Pa.

[21] Appl. No.: 334,267

[22] Filed: Apr. 6, 1989

[51] Int. Cl.[5] ..... B31F 1/12

[52] U.S. Cl. ..... 162/111; 162/112

[58] Field of Search ..... 162/111, 112, 113; 264/283

[56] References Cited

U.S. PATENT DOCUMENTS

| | | | |
|---|---|---|---|
| 1,626,527 | 4/1927 | Goodlett | 162/111 |
| 1,958,411 | 5/1934 | Alden | 162/112 |
| 2,610,935 | 9/1952 | Rowe | 264/283 |
| 3,014,832 | 12/1961 | Donnelly | 162/111 |
| 4,795,530 | 1/1989 | Soerens et al. | 162/112 |
| 4,849,054 | 7/1989 | Klowak | 162/111 |

FOREIGN PATENT DOCUMENTS

| | | | |
|---|---|---|---|
| 2152961 | 8/1985 | United Kingdom | 162/111 |
| 8200485 | 2/1982 | World Int. Prop. O. | 162/111 |

*Primary Examiner*—Peter Chin

*Attorney, Agent, or Firm*—John W. Kane, Jr.; R. Duke Vickrey; Mark G. Bocchetti

[57] ABSTRACT

An improved method, and resulting product, for creping a web of papermaking fibers by adhering the web to a creping dryer and with a creping blade removing the web from the creping dryer which provides increased absorbency with less reduction in strength. The improvement comprises reducing the cohesive forces between the fibers to a greater extent than reducing the adhesive forces between the web and the creping dryer accomplished by applying a fluid at least primarily comprising water overall to the side of the web away from the creping dryer in sufficient quantity and at a position to accomplish the improved results. The method is particularly useful in the practice of wet creping wherein the web is creped from the creping dryer at a dryness of from 45% to 60%.

6 Claims, 2 Drawing Sheets

METHOD FOR CREPING A PAPER WEB AND PRODUCT PRODUCED THEREBY

TECHNICAL FIELD

The present invention relates to the manufacture of creped paper webs primarily for use as sanitary paper products. In particular, it relates to an improved process for creping paper webs to improve their ability to absorb liquids with less reduction in their strength. The present invention also relates to an improved sanitary paper product which is more useful as a wiper.

BACKGROUND ART

In the past, there has been extensive activity in the field of papermaking to discover ways of imparting softness and absorbency to sanitary paper without excessively degrading its strength. Typically, such properties are imparted by creping the webs from a dryer surface, such as a Yankee dryer, with a creping blade. Such a process disrupts and breaks many of the interfiber bonds in the paper web which are formed during the drying thereof by the hydrate bonding process associated with papermaking. However, these interfiber bonds are the principal source of strength in conventional paper webs, so an increase in absorbency and softness is accompanied by a loss of strength.

The effectiveness of creping can generally be improved by increasing the adhesion of the web to the dryer surface. Such increased adhesion is conventionally provided by greater drying of the web before removing it with the creping blade. However, the drier the web, the greater will be the cohesive forces between the fibers and the more resistance the web will have to the creping action. Thus, in conventional creping, there is a balance needed between the interfiber cohesive forces and the adhesive forces between the web and the dryer surface to produce the most desirable results.

One form of conventional creping process is known as wet creping, in which the web is creped at a dryness of from about 45% to about 60%. In this dryness range, the web is sufficiently wet to have only a small portion of its final interfiber bonding in effect, which provides an opportunity to substantially increase or decrease the interfiber cohesive forces by varying the dryness at the creping blade. However, reduced interfiber bonding due to higher moisture is accompanied by reduced adhesion forces to the creping dryer. Thus, a desirable decrease in one force results in an undesirable decrease in the other force.

The creping effect from conventional wet creping has been studied extensively and has been found to be quite predictable. By varying the dryness level of the web at creping, different absorbency and strength results can be obtained over a wide range. The relationship between absorbency and tensile strength of the creped web has been found to be very consistent, and when the two properties are plotted against each other on a graph for varied examples, a line can be drawn which generally joins the values all together. This line shall be identified herein as the "Conventional Absorbency/Strength Curve."

It would be very desirable to modify the results of wet creping to provide an absorbency/strength relationship which is above (more absorptive) the Conventional Absorbency/Strength Curve. The desired modification could be accomplished by reducing the interfiber cohesive forces in the web more than the adhesive forces between the web and the creping dryer surface are reduced. The preferred method of the invention accomplishes this by spraying water onto the backside of the web just prior to creping and before the moisture has time to penetrate sufficiently into the thickness of the web to significantly reduce the adhesive forces. Prior art techniques for applying water to a paper web at the creping dryer were done either at the point where the web is pressed to the dryer or just before. In either case, it was applied sufficiently far in advance of creping to allow the water to spread uniformly through the thickness of the web, providing the equivalent of conventional wet creping at a higher moisture content due to the added water. In many of such applications, the water was used as a carrier for applying a chemical additive to the web, such as a flame retardant.

DISCLOSURE OF THE INVENTION

The invention is a method for creping a web of papermaking fibers by adhering the web to a creping dryer and with a creping blade removing the web from the creping dryer. The method is improved to provide increased absorbency with less reduction in strength. The improvement comprises reducing the cohesive forces between the fibers to a greater extent than reducing the adhesive forces between the web and the creping dryer by applying a fluid at least primarily comprising water overall to the side of the web away from the creping dryer in sufficient quantity and at a position sufficiently close to the creping blade to accomplish the improvement.

The preferred form of the invention is an improved method for wet creping a web of papermaking fibers having a basis weight of from about 11 pounds per ream to about 40 pounds per ream by adhering the web to a creping drier and with a creping blade removing the web from the creping drier at an average dryness of between 45% and 60%. The improvement comprises applying a fluid at least primarily comprising water overall to the side of the web away from the creping drier no sooner than 0.4 seconds before creping and in a sufficient quantity to lower the average dryness of the web from 2% to 10%, whereby the creping step will provide increased absorbency with less reduction in strength.

The invention is also the creped paper product produced in accordance with the method of the invention.

The invention is also the creped paper product produced in accordance with the method of the invention.

The invention is also a creped paper web having an absorbency/strength relationship above the Conventional Absorbency/Strength Curve.

BEST MODE FOR CARRYING OUT THE INVENTION

Figure 1:
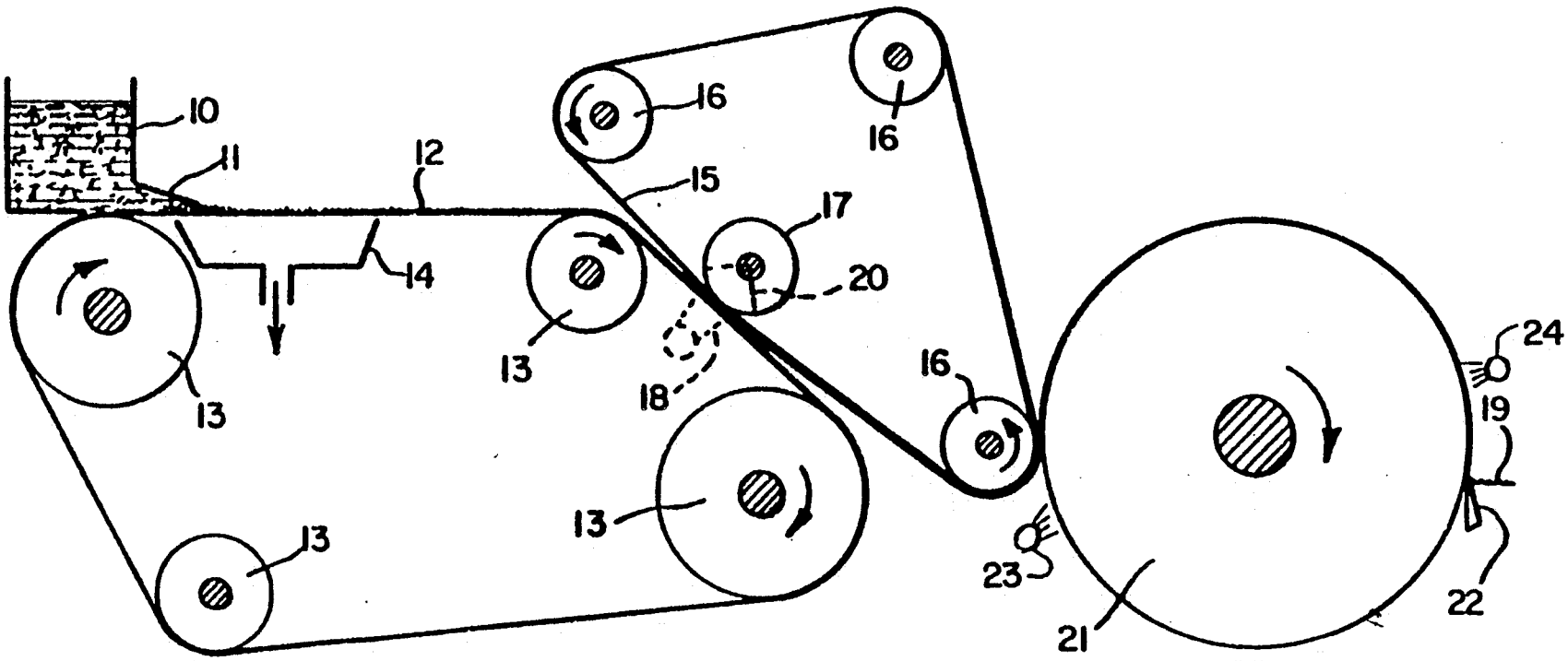
FIG. 1 is a schematic side elevation view of an apparatus suitable for practice of the present invention.

FIG. 1 schematically illustrates a papermaking machine which is capable of forming a web upon which the method of the present invention can be practiced. A headbox 10 is provided to hold a supply of fiber furnish, which generally comprises a dilute slurry of fibers and water. The headbox 10 has a slice 11 disposed over the moving surface of a condenser 12, which in this embodiment comprises a foraminous woven wire such as a Fourdrinier wire. The fiber furnish in headbox 10 issues from the slice 11 onto the surface of the wire 12. The wire 12 is carried through a continuous path by a plurality of guide rolls 13, at least one of which is driven by drive means (not shown). A vacuum box 14 is disposed beneath the wire 12 and is adapted to assist in removing water from the fiber furnish in order to form a web from the fibers. In addition, other water removal means, such as hydrofoils, table rolls and the like (not shown), may be employed beneath the upper flight of the wire to assist in draining water from the fiber furnish. Upon nearing the end of the upper flight of the Fourdrinier wire 12, the web is transferred to a second carrying member 15, which may be either a wire or a felt. This second carrying member 15 is similarly supported for movement through a continuous path by a plurality of guide rolls 16.

The transfer of the web from wire 14 to member 15 is accomplished by lightly pressing the carrying member 15 into engagement with the web on the wire 14 by a pickup roll 17. Actual web transfer from wire 14 to member 15 may be accomplished or assisted by other means such as an air knife 18 directed against the surface of wire 14 opposite the web, or a vacuum box 20 within the pickup roll 17, or both, such means being well-known to those skilled in papermaking techniques. At least one of the rolls 16 or 17 supporting the second carrying member 15 is driven by means (not shown) so that member 15 has a speed preferably equal to the speed of the wire 14 so as to continue the movement of the web. The web is transferred from member 15 to the surface of a rotatable heated dryer drum 21 such as a Yankee dryer. The web is lightly pressed into engagement with the surface of the dryer drum 21 to which it adheres, due to its moisture content and its preference for the smoother of two surfaces. As the web is carried through a portion of the rotational path of the dryer surface, heat is imparted to it, and sufficient moisture is removed by evaporation to increase the adhesion of the web to the dryer surface and provide sufficient web integrity to permit satisfactory creping action when the web 19 is removed from the dryer surface by creping blade 22. If desired, a creping adhesive can be added by such techniques as spraying it from a series of nozzles 23 disposed across the width of the dryer surface at a point not far from where the web is pressed to the dryer surface.

At a point in the rotation of the dryer drum 21 not far from the creping blade 22 is disposed a series of spray nozzles 24 across the width of the dryer drum for spraying the water employed in the invention.

The following examples are provided to illustrate the method and the products of the present invention and compare them with examples of the prior art and similar examples outside the scope of the invention. In all of the examples the papermaking fiber furnish consisted of 56% Northern softwood Kraft, 14% Northern hardwood Kraft and 30% Northern softwood CTMP fibers. A conventional wet strength resin, Kymene 557H (a poly(aminoamide)-epichlorohydrin resin manufactured by Hercules), was added to the wet end in an amount of 0.9% of the dry fiber weight.

The paper web upon being formed was adhered to a heated creping dryer and creped therefrom in a number of varied examples. A conventional creping adhesive was sprayed onto the Yankee surface in an amount found desirable to control the consistency of the adhesion. The first group of examples, Nos. 1–10, were processed under conventional wet crepe conditions. A second group of examples, Nos. 11–23, employed the improved process of the invention by spraying additional moisture onto the backside of the web shortly before the creping doctor (no sooner than 0.4 seconds before the web reached the creping doctor). A third group of examples, Nos. 24–28, also included spraying moisture onto the backside of the web just before creping, however they did not provide the benefits of the invention for reasons to be explained later.

In the examples, the following terms have the following meanings:

D—Average dryness of the web at the creping blade as a ratio of the bone dry fiber weight to the total web weight (fibers and water);

SA—Spray add-on of water in terms of the change in the average dryness effected by the spray (e.g., 5% add-on to a 55% dry web would reduce the average dryness to 50%);

BW—Basis weight of a single sheet of the creped web in pounds per ream of 2880 square feet, as measured after drying the web and standard conditioning;

GMBL—Geometric Mean Breaking Length of the creped web in meters, determined by the formula $GMBL=\sqrt{MD\times CD}/BW$, where MD is the tensile strength of the web in the machine direction and CD is the tensile strength of the web in the cross-machine direction and BW is the basis weight, with all units being chosen to result in meters of breaking length;

TWA—Total Water Absorbency in grams of water per gram of bone dry fiber in the web, determined in the following manner:

1. cut samples into squares 7.62 cm×7.62 cm;
2. condition each sample at 23° C. and 50% relative humidity;
3. weigh the dry sample;
4. attach each sample to clamps at the edges so that it will be suspended diagonally (with the edges at 45° to the vertical);
5. submerge the sample into a tank of distilled water at 23° C. for two minutes;
6. wet a small drainage strip of paper and attach it to the lowermost corner of the sample so that it overlaps about 6 mm and hangs vertically;
7. suspend the specimen from a rod in a covered drainage tank for 30 minutes;
8. remove the specimen from the drainage tank, remove the clamps and drainage strip and weigh the sample; and
9. calculate the weight of water held by the sample and divide it by the weight of the dry sample to provide TWA in grams of water/grams of dry paper.

| Example No. | D | SA | BW | GMBL | TWA |
|---|---|---|---|---|---|
| Conventional Wet Crepe | | | | | |
| 1 | 50% | — | 25.1 | 2273 | 2.3 |
| 2 | 55% | — | 25.2 | 1678 | 2.7 |
| 3 | 55% | — | 25.2 | 1907 | 2.5 |
| 4 | 55% | — | 24.8 | 2048 | 2.4 |
| 5 | 60% | — | 25.2 | 1498 | 3.3 |
| 6 | 75% | — | 19.3 | 1777 | 2.6 |
| 7 | 95% | — | 19.0 | 1856 | 2.3 |
| 8 | 60% | — | 14.3 | 1334 | 3.3 |

-continued

| Example No. | D | SA | BW | GMBL | TWA |
|---|---|---|---|---|---|
| 9 | 55 | — | 13.8 | 1563 | 2.73 |
| 10 | 60% | — | 10.7 | 890 | 3.78 |
| Examples of the present Inventon | | | | | |
| 11 | 45% | 5% | 24.7 | 2067 | 2.6 |
| 12 | 50% | 5% | 24.5 | 1828 | 3.1 |
| 13 | 53% | 2% | 24.7 | 1658 | 3.1 |
| 14 | 50% | 5% | 25.0 | 1732 | 3.0 |
| 15 | 55% | 5% | 24.5 | 1328 | 4.1 |
| 16 | 45% | 10% | 25.2 | 1835 | 2.8 |
| 17 | 55% | 10% | 24.7 | 1489 | 4.0 |
| 18 | 50% | 10% | 25.0 | 1605 | 3.6 |
| 19 | 60% | 10% | 25.0 | 1257 | 3.7 |
| 20 | 55% | 5% | 14.7 | 1287 | 3.3 |
| 21 | 60% | 5% | 14.9 | 1558 | 3.07 |
| 22 | 50% | 5% | 14.6 | 1692 | 3.29 |
| 23 | 55% | 5% | 14.3 | 1307 | 3.61 |
| Sprayed Examples Outside the Invention | | | | | |
| 24 | 70% | 5% | 19.3 | 1589 | 2.4 |
| 25 | 75% | 5% | 19.5 | 1948 | 2.3 |
| 26 | 90% | 5% | 19.3 | 2075 | 2.2 |
| 27 | 95% | 5% | 19.3 | 1898 | 2.2 |
| 28 | 55% | 5% | 10.3 | 915 | 3.76 |

Figure 2:
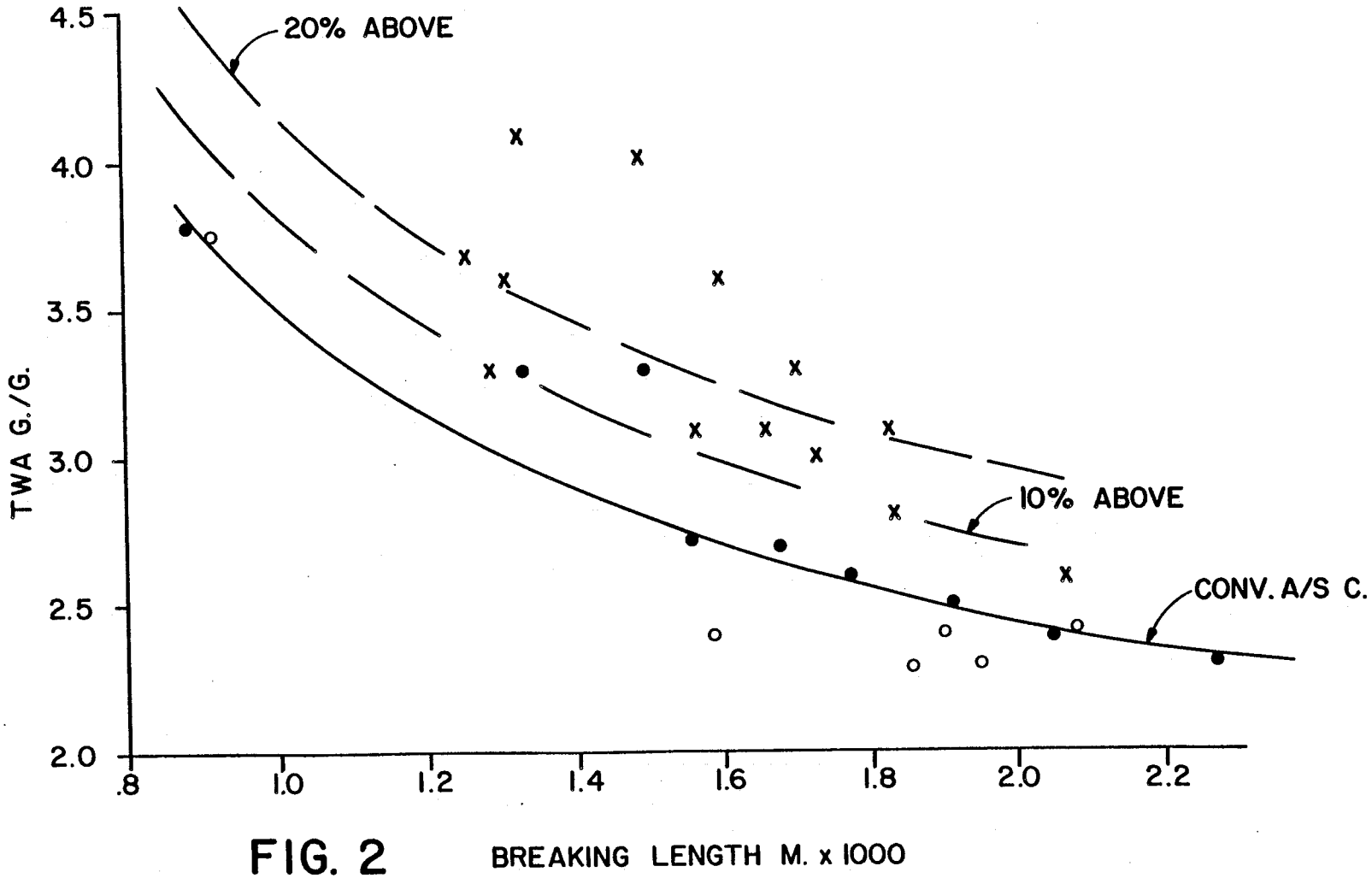
FIG. 2 is a graph illustrating the absorbency and tensile strength of various examples of the invention and of the prior art.

The TWA measurements for each of the examples were plotted against their corresponding Breaking Length measurements in FIG. 2. The values for all of the prior art conventional wet crepe examples were indicated as dots, the values for all of the examples of the invention were indicated as x's, and the values for all of the examples which employed the spray but were outside the invention were indicated as o's. A curve was drawn generally connecting all of the examples of the prior art to form the Conventional Absorbency/-Strength Curve, showing the known inverse relationship between strength and absorbency which results from conventional creping.

The goal of the present invention is to provide an absorbency/strength relationship above the Conventional Absorbency/Strength Curve. All of the examples of the invention show a significantly improved relationship of at least 10% in absorbency for the same tensile strength measurement. The invention generally provided an improvement of at least 15%, and frequently an improvement of at least 20%.

Examples 24 through 28, although employing the spray process of the present invention, did not display the improved relationship. The first four were creped at an average dryness of 70%, 75%, 90% and 95%, respectively, which is believed to be too dry for the invention to provide an improvement. The last example had a basis weight of about 10 pounds/ream, which is believed to be too light for the invention to provide an improvement.

Within the examples of the invention, the amount of moisture add-on was varied from 2% to 10%, with good results. Web basis weight was varied from about 14 pounds per ream to about 26 pounds per ream, with good results. Examples 28 had a web basis weight of below 11 pounds per ream, and that example showed essentially no improvement over the conventional wet crepe process. It is believed that its very thin web thickness made it difficult to reduce the cohesive forces of the web without also reducing the web's adhesion to the dryer surface. The same problem does not exist for thicker webs, and it is believed that the invention works best for webs between about 11 pounds per ream and about 40 pounds per ream of 2880 square feet. It is sheet products in this range which benefit most from the invention, since they are largely used for wiper products where fluid absorbency and strength are most important.

In practicing the process of the invention, it is necessary to apply the moisture over the entire surface of the web. The quantity of water applied can be varied across the width to adjust for moisture differences in the web in order to accomplish uniform crepe results across the width of the web. In some cases, the moisture can be applied uniformly across the width of the web with uniform results. Although the water can be applied by any one of a number of techniques, the preferred apparatus for accomplishing uniform application is a series of spray nozzles disposed across the width of the dryer surface. An example of a satisfactory spray apparatus is one comprised of spray nozzles spaced about 6 inches apart and all about 8 inches from the dryer surface and positioned about 6 feet in advance of the creping blade of a 20 foot dryer. The pressure of the moisture sprayed from the nozzle should be varied to provide the desired pattern.

The fluid to be sprayed onto the web is water, which can be alone or with small amounts of chemical additives for creating special properties in the paper. However, it is the water which provides the essential creping action necessary for the invention. The water can be sprayed hot or at room temperature. It is particularly desirable to spray the water hot, for example, at 170° F., to avoid excessive cooling of the heated dryer surface.

Absorbency of a web is a function of both absorption by the fibers in the web and and absorption within the spaces between the fibers. In this regard, the primary function of the process of the invention is to spread the fibers apart by increasing the bulk of the web. All of the examples of the invention have been described as single ply webs. It is possible to increase the absorbency of a paper web above the Conventional Absorbency/-Strength Curve by placing two plies together in a manner which creates void spaces between the plies to improve the absorbency. However, the present invention can accomplish this goal with a single ply, and two or more plies of the product of the invention can be plied together for even greater improvement. However, for purposes of defining the invention, the properties of only one ply are considered. Of course, the invention still includes any multi-ply paper product in which at least one of the plies is a web of the invention. Furthermore, the invention also covers products of the invention with other further processing, such as embossing and the like.

What is claimed is:

1. A method for creping a web of papermaking fibers comprising:

adhering the web to a creping dryer;

reducing the cohesive forces between the fibers to a greater extent than reducing the adhesive forces between the web and the creping dryer by applying a fluid at least primarily comprising water in sufficient quantity to lower the average dryness from about 2% to about 10% overall to the side of the web away from the creping dryer in close proximity to the creping blade; and creping the web from the creping dryer at an average dryness of from about 45% to about 60% before the fluid applied penetrates through the web to the creping dryer.

2. The improved method of claim 1, wherein the claimed improvement for a single ply of the web is an absorbency of at least 10% higher than obtained on a Conventional Absorbency/Strength Curve for the same tensile strength, the Conventional Absorbency/-Strength Curve being the relationship between absorbency measured in grams of water per gram of bone dry fiber and breaking length determined in meters of a conventionally wet creped web made without the application of said fluid.

3. The improved method of claim 1, wherein the claimed improvement for a single ply of the web is an absorbency of at least 15% higher than obtained on a Conventional Absorbency/Strength Curve for the same tensile strength, the Conventional Absorbency/-Strength Curve being the relationship between absorbency measured in grams of water per gram of bone dry fiber and breaking length determined in meters of a conventionally wet creped web made without the application of said fluid.

4. The improved method of claim 1, whererin the claimed improvement for a single ply of the web is an absorbency of at least 20% higher than obtained on a Conventional Absorbency/Strength Curve for the same tensile strength, the Conventional Absorbency/-Strength Curve being the relationship between absorbency measured in grams of water per gram of bone dry fiber and breaking length determined in meters of a conventionally wet creped web made without the application of said fluid.

5. In a method for wet creping a web of papermaking fibers having a basis weight of from about 11 pounds per ream to about 40 pounds per ream by adhering the web to a creping drier and with a creping blade removing the web from the creping drier at an average dryness of between 45% and 60%, the improvement which comprises applying a fluid at least primarily comprising water overall to the side of the web away from the creping drier in a period of 0.4 seconds or less before creping and in a sufficient quantity to lower the average dryness of the web from 2% to 10%, and creping the web before the fluid penetrates through the thickness of the web to the surface of the creping drier, whereby the creping step will provide increased bulk and absorbency with less reduction in strength than a conventionally wet creped web made without the application of said fluid.

6. In a method for creping a web of papermaking fibers by adhering the web to a creping dryer and with a creping blade removing the web from the creping dryer at an average dryness of from 45% to 60%, the improvement comprising:

applying water to the side of the web away from the creping dryer in sufficient quantity to lower the average dryness of the web from 2% to 10%; and creping the web before the applied water penetrates through the web to the creping dryer.

* * * * *